United States Patent [19]

Gilbertson et al.

[11] Patent Number: 4,928,493

[45] Date of Patent: May 29, 1990

[54] ICE BUILDING, CHILLED WATER SYSTEM AND METHOD

[75] Inventors: Thomas A. Gilbertson, Moraga; Michael R. Meyers, Sonoma; Bruce Kinneberg, Martinez, all of Calif.

[73] Assignee: Reaction Thermal Systems, Inc., Napa, Calif.

[21] Appl. No.: 311,215

[22] Filed: Feb. 14, 1989

Related U.S. Application Data

[63] Continuation-in-part of Ser. No. 284,890, Dec. 6, 1988, which is a continuation-in-part of Ser. No. 11,617, Feb. 6, 1987, abandoned.

[51] Int. Cl.[5] ..... F25D 3/00

[52] U.S. Cl. ..... 62/185; 62/201; 62/437; 62/59; 165/10

[58] Field of Search ..... 62/437, 430, 434, 435, 62/59, 99, 185, 201, 66; 165/10 A, 902, 104.14, 104.17, 104.21; 126/400; 252/70

[56] References Cited

U.S. PATENT DOCUMENTS 4,283,925 8/1981 Wildfeuer ..... 62/434
4,613,444 9/1986 Lane et al. ..... 165/10 A

FOREIGN PATENT DOCUMENTS 0210293 12/1982 Japan ..... 165/10 A
0158989 9/1984 Japan ..... 165/10 A
0200191 11/1984 Japan ..... 165/10 A

*Primary Examiner*—Harry B. Tanner
*Attorney, Agent, or Firm*—Lowell C. Bergstedt

[57] ABSTRACT

A chill water system combining a storage vessel 10, a multiplicity of ice encapsulating units 11 contained in the vessel and a chiller system 60. The storage vessel contains a volume of glycol and water solution having a freezing point of about twenty six degrees F. The ice encapsulating units 11 comprise sealed containers filled with a deionized water and having a volume of powdered cholesterol therein to serve as an ice nucleating agent to lower the initial ice formation temperature of the unit. The containers have imperfect geometric shape and deformable wall structures to permit an increase in enclosed volume as said water therein freezes. Chiller system 60 is operatively associated with the vessel and cools the glycol and water solution to about twenty six degrees to freeze the water in the containers 11. A topping tank 90 and an inventory tank 93 receive liquid from the storage vessel 10 as the ice encapsulating units 11 freeze and expand in volume.

6 Claims, 3 Drawing Sheets

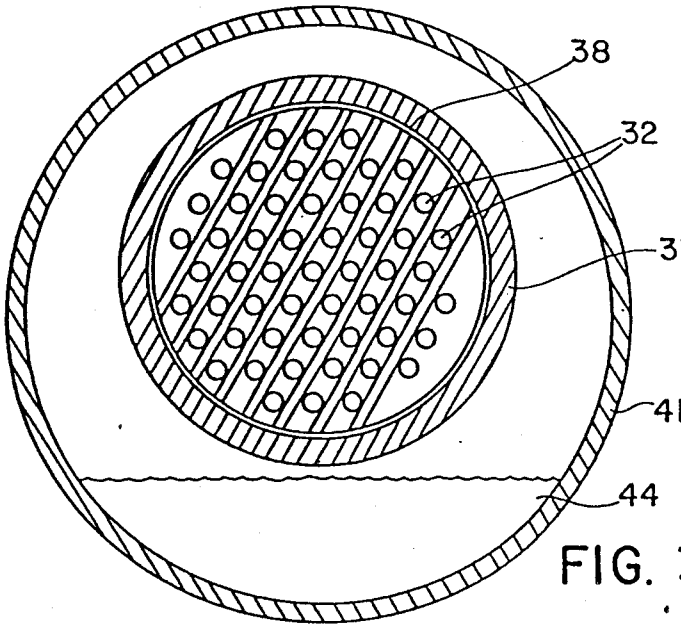
FIG. 3
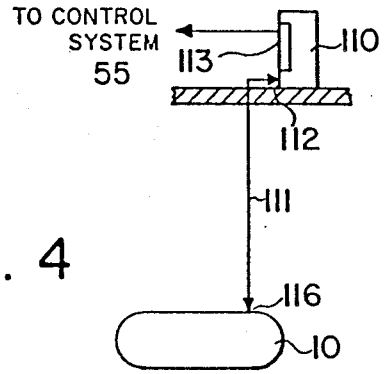
FIG. 4
FIG. 5
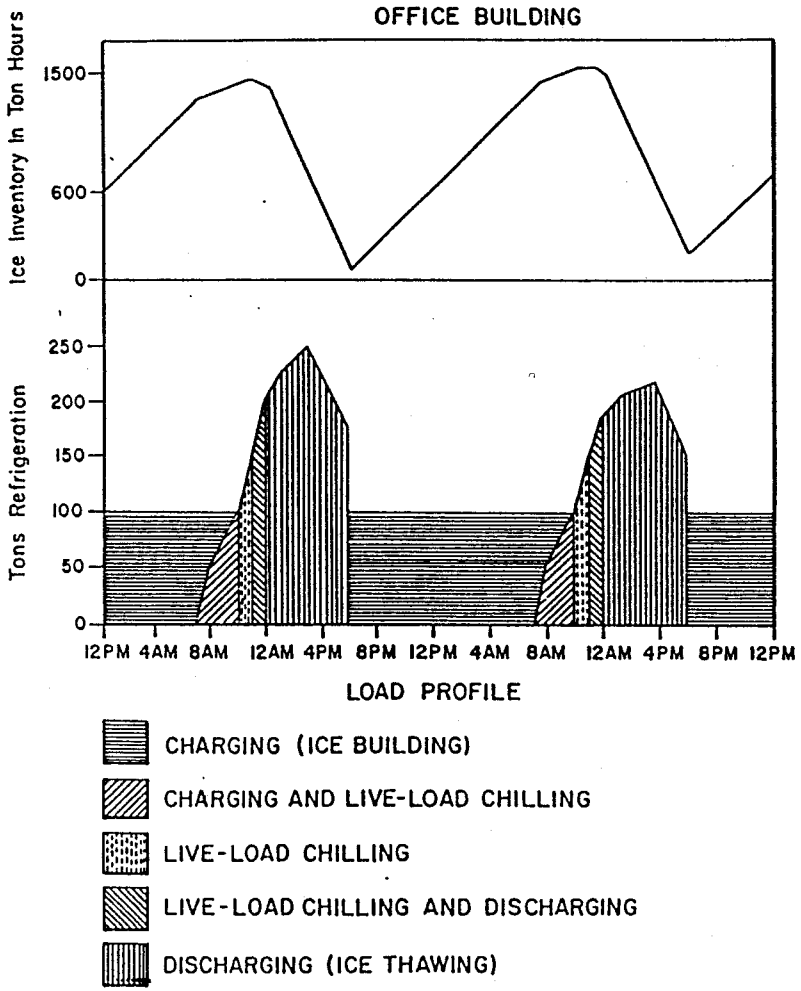

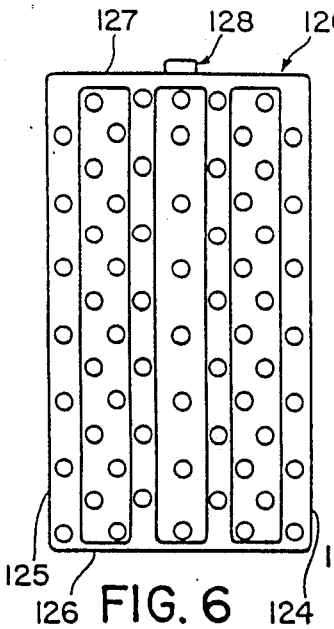
FIG. 6
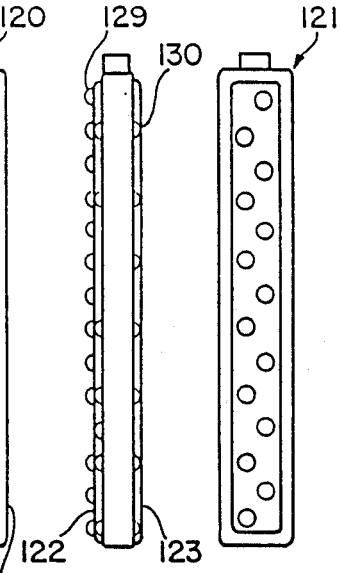
FIG. 7
FIG. 8
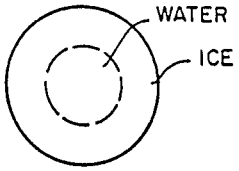
FIG. 9B
(PRIOR ART)
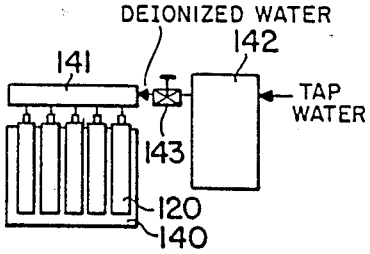
FIG. 10
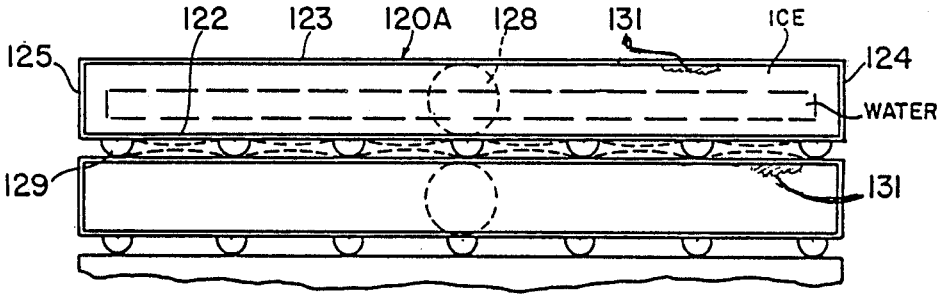
FIG. 9A
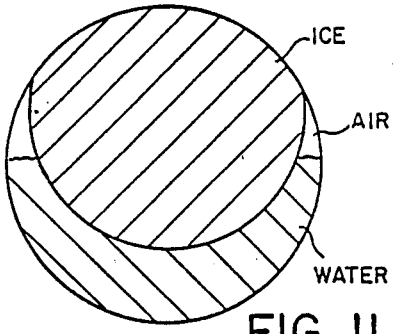
FIG. 11
(PRIOR ART)
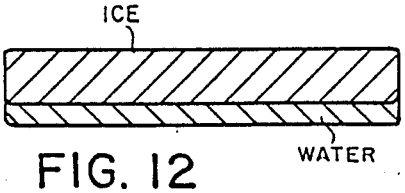
FIG. 12

ICE BUILDING, CHILLED WATER SYSTEM AND METHOD

CROSS-REFERENCE TO RELATED APPLICATIONS

This application is a continuation-in-part of copending U.S. patent application Ser. No. 284,890, filed Dec. 6, 1988 (with effective filing date of Feb. 4, 1988 as PCT/US88/00325) which is a continuation-in-part of copending U.S. patent application Ser. No. 011,617, filed Feb. 6, 1987, abandoned and entitled "Ice Building, Chilled Water System and Method."

FIELD OF THE INVENTION

This invention relates generally to systems and methods for producing chilled water to be used, for example, in air conditioning and process cooling applications. More specifically, this invention relates to chilled water systems and methods which involve thermal energy storage based on building ice during nighttime hours and harvesting the ice to produce chilled water during peak electrical load demand during the daytime. The term "water" is sometimes used to designate generically the working liquid of the system which is typically water treated with rust inhibitors or water which has other chemicals added to alter the freezing temperature characteristics thereof.

BACKGROUND OF THE INVENTION

A number of different systems and methods for achieving thermal energy storage are in commercial use today. These systems fall into several general categories: ice on coil systems, ice harvester systems, brine circulation systems, slush making systems, and ice encapsulating storage systems using eutectic salts or water.

ICE ON COIL SYSTEMS

The largest number of units on the market are "ice on coil" systems in which the ice is actually grown on the outside of refrigerant carrying coils that are placed in a storage tank filled with water. Gilbertson U.S. Pat. No. 4,656,836 discloses an ice-on coil system which represents the most advanced state of this type of prior art system. Ice on coil systems have a number of problems and limitations that have impeded their wide acceptance. They require the use of long coils of pipe inside the storage tank to provide enough ice growing surface to produce the number of ton-hours of ice storage required for the application. These long coils are expensive from a materials and fabrication standpoint. Furthermore, they typically require the use of a large volume of refrigerant to charge the system. This refrigerant charge is expensive and loss of the entire refrigerant charge if a leak develops is an inherent risk.

Ice on coil systems grow ice only to the point of occupying about fifty percent of the volume of the storage tank. Thus these systems are typically specified as requiring about three cubic feet per ton-hour of ice storage. While the Gilbertson '836 patent discloses an ice on coil system with closed, pressurized storage tanks for direct connection to the chilled water utilization system, most ice on coil system use open atmospheric tanks and require a separate heat exchanger interface to any chilled water utilization system having a substantial static pressure head.

ICE HARVESTOR SYSTEMS

In ice harvester systems, ice is first built on a heat transfer surface (evaporator) cooled with a liquid refrigerant and then harvested off of the surface by mechanical means or by using a flash defrost cycle to melt the layer of ice near the heat transfer surface. The ice building and harvesting equipment must be physically mounted over the storage tank into which the ice is dropped when harvested. Ice harvester systems occupy a large space, are complicated and difficult to install, and require about 3.3 cubic feet per ton hour of storage due to the geometric profile assumed by the ice as it falls into the tank.

BRINE SYSTEMS

Brine systems are like ice on coil refrigerant systems except that a twenty-five to thirty percent brine solution is cooled in a separate chiller and then circulated through plastic pipe coils in the storage tank to build ice on the coils. This same brine solution is circulated through the coils and the load to harvest the cooling effect of the ice built on the coils. These brine systems have reduced heat transfer efficiency and require more pumping horsepower due to the density and viscosity of the working fluid. They also require larger heat transfer coils on the load side of the system compared to chilled water systems that use treated water or a weak brine solution.

Brine systems are difficult to use in retrofitting an existing chill water installation because the brine forces a derating of the already installed system components on the load side. Substantial additional costs may be required to install larger coils in the load side equipment. The brine type of thermal storage systems are typically specified at about 4.2 cubic feet per ton hour of ice storage.

SLUSH ICE PRODUCERS

There are also systems currently available to produce slush ice for a thermal storage system. One such system uses a large diameter, horizontally disposed chiller tube and low velocity flow of the water through the tube together with an impeller type of agitator to keep the slush ice moving through the chiller system. Another system uses an arrangement of large diameter vertical chiller tubes, each having a highly polished interior surface down which a film of water flows, gradually turning to ice on the chilled surface and then droping off the end of the tube into the storage tank. Both of these systems are complex, relatively expensive and difficult to install.

Another slush ice producing system is disclosed in Martin et al. U.S. Pat. No. 4,401,449. In this system, water is pumped at high volume through a serpentine chiller coil. The '449 patent teaches that ice crystals are formed on the interior walls of the chiller coil and are eventually scrubbed off by the high velocity of the water flowing through the coil. The ice crystal and water mixture is collected in an ice accumulation tank at atmospheric pressure and the patent states that formation of additional ice crystals is enhanced by the reduction in pressure as the mixture leaves the chiller coil.

Slush ice systems do not have a high ice packing density and require from 2.5 to 3.0 cubic feet per ton-hour of ice storage. Control of the refrigeration side of the system during ice production can be difficult.

ICE ENCAPSULATING SYSTEMS

In ice encapsulating systems, the ice forming medium is stored in special containers placed in a storage vessel and a chilled liquid is circulated over the containers to freeze the encapsulated medium during the ice building cycle. During the thawing cycle, a liquid is pumped over the containers to be cooled and then supplied to the cooling load circuit.

EUTECTIC SALT SYSTEMS

Eutectic salts stored in special containers are used in one type of ice encapsulating system. These salts freeze without expansion at about forty-seven degrees F. and thus produce chilled water at about fifty degrees F. compared to the forty-two to forty-five degree F. temperatures which are achieved in most chill water systems. These higher chill water temperature require major upsizing of the load side heat transfer components to achieve the rated cooling. This adds considerable expense in retrofit installations. Thus these eutectic systems do not provide one of the major advantages of ice building thermal energy storage systems. That advantage is to produce supercooled water for the load side and all the accompanying benefits of actual downsizing of the load side piping, the water coils in the air handling units and the air blower horsepower. These eutectic salt systems typically require about 5 cubic feet per ton hour of storage so ice storage efficiency is low. Leakage of the containers holding the eutectic salt material with resultant corrosion of system components is a risk in these systems.

RIGID SPHERE SYSTEM

Another prior art system stores negative thermal energy for use in cooling in sealed rigid plastic spheres which are either filled with a special liquid chemical that does not expand when it freezes or are partially filled with water to allow for internal expansion during freezing. This type of system is expensive and requires special handling of the thermal storage spheres because they must be filled and sealed at the factory. This creates additional shipping expense due to the weight of the filled spheres.

These rigid sphere ice encapsulating systems require between 2.0 and 2.5 cubic feet per ton-hour of ice storage. Furthermore, if standard copper tube chillers are used to chill the working fluid, a twenty-five to thirty percent glycol in water solution is used to prevent freeze up of liquid in the chiller tubes. Such a freeze up would rupture the copper tubes and destroy the chiller. This concentration of glycol reduces the heat transfer efficiency in the chiller and in the load side chilled water coils and requires use of higher pump horsepower to pump the more viscous liquid.

In general all of the prior art systems have one or more limitations of cost, complexity, size or configuration restrictions. These limitations have tended to discourage the use of thermal storage technology despite the otherwise clear social and economic advantages of the thermal storage concept. This is especially true of the retrofit segment of the market. It is difficult and expensive to adapt most of the prior art systems for retrofitting existing chilled water air conditioning systems with ice building thermal storage components. In particular, the prior art systems are ill-suited from a cost and performance standpoint to be used in retrofit projects involving medium-sized conditioned spaces on the order of 30,000 to 50,000 square feet.

There is a definite need in the art for an improved ice building, thermal storage system that will accelerate the acceptance of this technology both for new construction projects and for retrofitting existing commercial installations of all sizes from medium sized projects (30–50,000 square feet) to extra large projects (over 100,000 square feet).

SUMMARY OF THE INVENTION

Objects of the Invention

The principal object of this invention is to provide an improved ice-building, chill water system and method.

It is another object of this invention to provide an ice-building chill water system with improved ice building characteristics.

It is another object of this invention to provide an improved ice encapsulating unit for use in ice-building chill water systems.

It is another object of this invention to provide an ice encapsulating unit with improved thermal ice-building performance.

FEATURES AND ADVANTAGES OF THE INVENTION

One aspect of this invention feature a chill water system which combines structural means defining a vessel for containing a volume of a first liquid characterized by a first freezing temperature substantially lower than water with a multiplicity of ice encapsulating units disposed in said vessel and occupying a major portion of the volume thereof, each of said ice encapsulating units comprising sealed container means being filled with water and having a volume of cholesterol therein serving as an ice nucleating agent for said water. A liquid chilling system operatively associated with said vessel cools said first liquid in said vessel to a temperature above said first freezing temperature and below the freezing temperature of water.

Another aspect of this invention features an ice encapsulating unit adapted for use in a chill water system and comprising a sealed container means, a volume of water carried in said sealed container means, and a volume of cholesterol carried on the interior of said sealed container means and serving as an ice nucleating agent to raise the initial ice nucleating temperature of said water therein.

Another aspect of this invention features a method for producing chilled water comprising the steps of:

a. forming a container for a holding a volume of water;

b. disposing a small volume of cholesterol within the interior of said container to serve as an ice nucleating agent;

c. dispensing a volume of water into said container;

d. sealing said container;

e. circulating a chilled heat transfer fluid over said sealed container during a freeze cycle until said water on the inside of said container is entirely converted to ice; and f. circulating said heat tranfer fluid over said sealed container during a thaw cycle to entirely melt said ice inside said container;

g. performing steps e and f repeatedly with said volume of cholesterol repeatedly serving to raise the initial ice nucleation temperature of said water and thereby enhancing the ice formation within said container and increasing the energy efficiency of performing step f.

Step b. may advantageously be performed by spraying a small volume of commercial grade powdered cholesterol into said container.

The volume of cholesterol in the ice encapsulating unit or container provides the advantage of raising the temperature at which initial ice formation begins in the water in the container and thus reduces the amount of energy required to initiate the ice formation process. This permits lower concentrations of freeze depressant materials to be employed in the heat transfer liquid circulated over the containers which further improves the efficiency and heat transfer performance of the system.

Other objects, features and advantages of this invention will become apparent from a consideration of the following detailed description of the invention taken in conjunction with the accompanying drawings.

BRIEF DESCRIPTION OF THE DRAWINGS

FIG. 3 is a section view of a chiller system useful in connection with this invention and taken along the lines 3—3 in FIG. 1.

FIG. 4 is a partial schematic drawing illustrating an alternative topping tank arrangement useful in connection with this invention.

FIG. 5 is a graph illustrating a sequence of operating modes for an ice building, chill water system in accordance with this invention.

FIG. 6 is a plan view of one embodiment of an ice encapsulating unit in accordance with this invention.

FIG. 7 is a side view of an embodiment of an ice encapsulating unit in accordance with this invention.

FIG. 8 is a plan view of another embodiment of an ice encapsulating unit in accordance with this invention.

FIG. 9A is a diagram illustrating features of ice encapsulating units in accordance with this invention.

FIG. 9B is a diagram illustrating features of ice encapsulating units of the prior art.

FIG. 10 illustrates a convenient system for filling ice encapsulating units with deionized water at the installation site.

FIG. 11 illustrates the ice melting characteristics of a prior art ice encapsulating unit in the form of a rigid sphere.

FIG. 12 illustrates the ice melting characteristics of a preferred configuration of ice encapsulating unit in accordance with this invention.

DETAILED DESCRIPTION OF INVENTION EMBODIMENTS

Figures 1, 2:
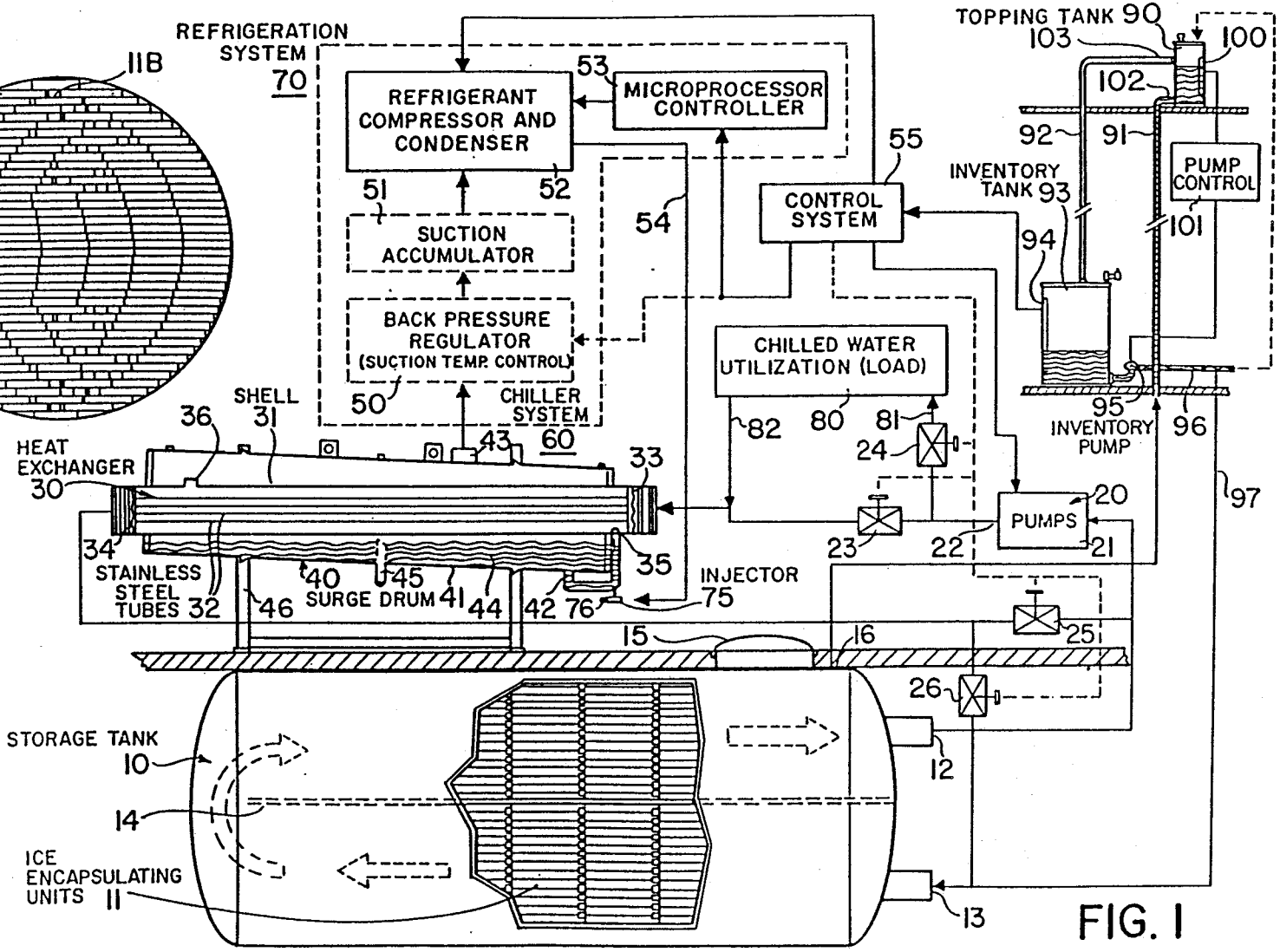
FIG. 1 is a schematic drawing of one embodiment of an ice storing chilled water system in accordance with this invention.
FIG. 2 is a vertical section view through a storage tank illustrating a packing arrangement for ice encapsulating units in accordance with this invention.

FIG. 1 illustrates the major components of a system for ice building and storage in accordance with this invention. These components include a storage vessel or tank 10 with ice encapsulating units 11 placed therein, a liquid chiller system 60, and a refrigeration system 70. Although the components of the system are shown in FIG. 1 as being located near one another, it should be understood that one of the advantages of this invention is that the various components can be located remote from each other. For example, the storage tank 10 can be buried underground in the basement of a building or under an outdoor parking lot. The chiller system can be located in the basement equipment room of the building. The refrigeration system can be located at a distance from both, but it is generally preferrable for the chiller system and the refrigeration system to be close together to minimize the distance that the refrigerant travels between the two systems.

The system of this invention lends itself readily to a packaged chiller approach in which the chiller system 60 is packaged with the compressor and condenser of the refrigeration system. In this approach, all of the connections between the units are made at the factory and the refrigerant charge is loaded at the factory. This simplifies installation of the system since only water side connections are then required.

FIG. 1 shows a structural arrangement including a storage vessel 10 with a multiplicity of ice encapsulating units 11 disposed throughout the internal volume of the vessel. Vessel 10 has an outlet 12 and an inlet 13. Outlet 12 is connected in a liquid flow circuit through a chiller pump 20 and a heat exchanger 30 which is part of a liquid chilling system, including chiller system 60 and refrigeration system 70, and back into the inlet 13. Heat exchanger 30, shown in cross-section in FIG. 3, comprises a generally cylindrical shell 31 having a multiplicity of small bore stainless steel tubes disposed in a mutually separated parallel arrangement between an inlet header 33 and an outlet header 34. Shell 31 has a refrigerant inlet 35 near one end and a refrigerant outlet 36 near the other end. Additional structural details of heat exchanger 30 will be given below.

Heat exchanger 30 is disposed in a generally concentric orientation within a hollow cylindrical surge drum 40. Surge drum 40 comprises a steel shell 41 preferrably canted slightly relative to a horizontal plane so that a pool of liquid refrigerant 40 therewithin will have a greater depth and thus a greater liquid head pressure at the refrigerant outlet port 42 which is located in a bottom wall of the surge drum near one end. The outlet port 42 is preferrable placed near the refrigerant inlet 35 of the heat exchanger 30. Surge drum 40 has a refrigerant suction port 43 located in a top wall portion and communicates with a refrigerant system 70. Surge drum 40 preferably has a layer of insulation (not shown) surrounding the shell 44. Exposed portions of the heat exchanger 30 and the piping sections between it and the storage tank 10 are preferrably also insulated.

Refrigerant suction port 43 in surge drum 40 couples evaporated refrigerant gas through a back pressure regulator valve 50 (not needed with some types of compressors) and a suction accumulator 51 (optional in most cases) to a refrigerant compressor and condenser system 52. The surge drum is preferrably sized to provide complete separation of gas and liquid refrigerant, but the suction accumulator, if included, will separate and accumulate any residual refrigerant liquid travelling with the gas and convert it into gas by evaporation over time. An oil return circuit (not shown) of standard design is preferrably provided between the oil return port 45 of the surge drum 40 and the suction accumulator 51 or the suction line to the compressor itself to remove oil from the liquid refrigerant in the surge drum and return it to the compressor 52. The oil return port 45 extends to the top surface of the pool of liquid refrigerant in the surge drum so that some of the oil rich liquid at the surface is removed for the oil return circuit.

Back pressure regulator 50 provides suction temperature control for installations in which a reciprocating compressor is utilized. In most screw compressor applications, this regulator is not required because the suction temperature can be controlled with the slide valve controller on the compressor itself. This slide valve controller is under the control of microprocessor controller 53 and suction temperature control can thus be programmed into the controller. A control system 55 for the overall system of this invention may then operate in concert with the controller on the compressor to provide suction temperature control for the different operating modes of the system described below.

Hot, high pressure liquid refrigerant at outlet line 54 from the refrigerant condenser 53 is coupled to the liquid refrigerant injector 75. Injector 75 is also coupled to the cold liquid port 42 of the surge drum 40. The outlet of the injector 75 is fed to the refrigerant inlet 35 of the heat exchanger 30. Injector 75 uses the higher pressure of the hot liquid refrigerant to carry with it a volume of the cold liquid refrigerant from the bottom of surge drum 40 through the injector into the inlet port 35. The operation of these components is described below in more detail.

FIG. 1 also shows a chilled water utilization circuit (or load) 80 coupled into the overall system. This utilization circuit may be, for example, the load side of an air cooling system in a commercial store or office building. Flow control valves 23–26 are shown in various locations in the overall chill water circuit to control flow of the heat transfer liquid and are turned on and off in various combinations to produce various operating modes of the overall system. These operating modes will be described below.

As shown in FIGS. 1 and 2, storage tank 10 has a large number of ice encapsulating units placed therein in a three dimensional array. The details of the structure of the individual ice encapsulating units will be described below, but FIG. 2 illustrates that the preferred configuration of ice encapsulating units permits them to be stacked in a way that produces liquid flow channels between the major top and bottom walls thereof. These liquid flow channels also provide space for expansion of the ice encapsulating units as the water inside freezes during the ice building cycle of the system.

As shown in FIGS. 1 and 2, a baffle 14 in the form of a section of flexible baffle made of rubber or a PVC material or other flexible material divides the interior of the tank into two separate flow channels so that liquid entering the inlet 13 flows over a bank of ice encapsulating units in the bottom section of the tank and then flows back toward the outlet 12 over a bank of ice encapsulating units in the top section of the tank. Baffle 14 is fastened to the front interior wall of the rounded front head of the tank and to the side interior walls of the tank so that liquid bypass around the baffle cannot occur. Any convenient method of securing the edges of the baffle to the inside walls of the vessel may be used. The baffle arrangement forces the liquid to take a long path through the storage tank and thus remain in contact with heat transfer surface of the ice encapsulating units for a long dwell time in the tank. An arrangement of three baffles could be used to provide a four pass compartmentalizing of the storage tank. Liquid distributing headers (not shown) are placed inside the tank at the inlet and outlet to ensure an even distribution in the flow of the liquid over the ice encapsulating units when entering and leaving the tank.

Access to the interior of storage tank 10 is provided through a manway 15 and the tank is optionally located at or above grade or buried underground. If buried underground, or installed where exposed to the weather, the exterior of the tank is coated to protect against corrosion.

The storage tank 10 is shipped to the installation site as a completely manufactured but empty tank, i.e. with no ice encapsulating units inside. The containers that form the ice encapsulating units 11 are also shipped empty to the installation site and filled with water at the site. At initial installation, the interior of the storage tank 10 is first filled with the ice encapsulating units and then the remaining volume of the tank is filled with a mixture of glycol (or other appropriate freeze point depressant chemical) and water. Since the ice encapsulating units expand during freezing, provision must be made in the overall structural arrangement to displace liquid from the interior of the tank during the ice building cycle. As shown in FIG. 1, a topping tank 100 is provided and is placed at a location in the structure served by the chill water system which is higher than the highest point to which the chilled water is to be pumped. A pipe 91 connects the bottom port 102 of the topping tank to a port 16 at the top of storage tank 10. The topping tank and the pipe 91 are filled with glycol and water during installation to a level of the overflow port 103 in the topping tank. This equalizes the static head pressure between the storage tank 10 and the chill water utilization circuit 80 so that liquid from the chill water utilization circuit will not back up into the storage module when the pumps are shut down. Topping tank 90 is preferably constructed with a volume that is only a fraction of the total volume of liquid that is displaced from the storage tank during freezing of the ice encapsulating units. The overall structural arrangement also includes an inventory tank 93 is provided to store the overflow of displaced liquid and is connected to the topping tank through an overflow pipe 103 leading from the overflow port 103. Inventory tank 93 is preferably installed at or near grade level.

As liquid from the topping tank overflows into the inventory tank due to displacement by the ice encapsulating units, the height of the liquid in the inventory tank is a measure of the volume of ice that has been formed in the storage tank 10. During the ice building cycle, the liquid level guage 94 monitors the height of the liquid in the inventory tank and signals the control system 55 to turn off the refrigeration system 70 and the pumps 20 when the system is full of ice. The full level in the inventory tank is calibrated on initial system installation as the highest level of fluid displaced into it during the initial freeze cycle. It will be appreciated that the control system 55 could be arranged to be programmable to build a selectable percentage of the total ice storage capacity of the system. However, in most installations, the system will be operated to build and store a full charge of ice during each ice building cycle or as much ice as can be built during that cycle if an ice thawing, chill water production cycle is started before a full ice charge is accumulated.

During the ice thawing cycle, the volume of storage tank 10 occupied by the ice encapsulating units will decrease as the ice therein melts. As this occurs, volumes of liquid from the topping tank 90 will return to the storage tank 10 and the level in the topping tank will fall. A liquid level guage 100 in the topping tank signals a pump control 101 when the level drops and pump control 101 operates inventory pump 95 to pump liquid form the inventory tank 93 into the storage tank 10 via a pipe 97 leading to inlet 13. A one-way check valve 96 prevents reverse flow of liquid from the storage tank into the inventory tank. The inventory pump 95 could alternatively pump liquid directly into the topping tank 90 through a pipe 98. It should be understood that the topping tank and inventory tank shown in FIG. 1 are not to scale. Sizes of various models of the components of the system will be discussed below.

FIG. 4 illustrates an alternative arrangement for handling the displacement of liquid from the storage tank during freezing and return of the displaced liquid during thawing of ice encapsulating units. In this embodiment, topping tank 110 is fabricated to hold the entire volume of liquid displaced from the storage tank so that a separate inventory tank is not required. A single level guage 113 reports the level of displaced liquid to the control system 55 so that it knows when the system is filled with ice. The displacement of liquid during the ice building cycle and the return of liquid during the ice thawing cycle happens automatically since the two tanks are directly connected. Of course the larger topping tank must be located at a place where its weight can be safely supported.

It will be understood that in some cases the storage tank itself may be mounted on the roof of the building or at the high point of the system. In this case the storage tank could be arranged to overflow directly into an inventory tank at grade level and the inventory pump could be used to pump liquid back to the storage tank on the roof. Alternatively, a topping tank could be mounted just above the storage tank and connected thereto for direct communication of displaced water between the two tanks.

SYSTEM OPERATING MODES

Consider now the various operating modes of the system of the invention shown in FIG. 1. Chiller system 60 and refrigeration system 70 are designed to operate in two basic modes. The first mode is an ice building mode, during which the suction temperature regulating device is set for a minimum suction temperature of about twenty degrees F. The second mode is a live load chiller mode, during which the suction temperature is raised to a level appropriate to the higher temperatures entering and leaving the heat exchanger 30. This also increases the effective refrigeration tonnage of the system by as much as fifty percent.

FIG. 5 illustates the operation of a typical "partial storage" installation of an ice building chill water system of this invention in an office building. It is a partial storage installation because the stored ice capacity is designed to be insufficient to supply all of the cooling required by the building on a typical design day. Instead, the refrigeration system will be operated to provide direct cooling during non-peak demand sections of the overall operating cycle, namely from seven a.m. to noon. Curve A shows the building load profile in tons of refrigeration required to cool the building at various times of the day. Curve B shows the ice inventory in the storage tank during various periods of operation. A linear ice charging curve is shown for simplicity although the actual curve is not a straight line. As shown, the chill water, air cooling system in this office building example is only operated during the hours from seven a.m. to six p.m. The installed system is designed for about 1500 ton hours of ice storage and the refrigeration system delivers 100 tons of refrigeration during the ice building period and up to about 150 tons of refrigeration when the system is operated in a live load chiller mode.

THE ICE BUILDING MODE

During the time period from six p.m. to seven a.m. the system is operating in the ice building or "charging" mode. Control system 55 has set the suction temperature at outlet port 43 of the surge drum at twenty degrees F. and the refrigeration system is turned on. Valves 23 and 26 are open and valves 24 and 25 are closed so that the glycol/water solution is flowing through the heat exchanger 30 and the storage tank 10, but not through the load. The liquid leaving the storage tank will be at about twenty eight and one half degrees F. and the liquid leaving the heat exchanger 30 and entering the storage tank will be at about twenty six degrees during most of this period. The temperature of the heat exchange fluid during this mode is importantly related to the initial ice nucleation temperature of the ice encapsulating units 11 if a large number of the units have been completely thawed during the last cycle.

ICE BUILDING AND LOAD CHILLING MODE

At seven a.m. the building air cooling is switched on, and the system is set up to begin operating in a combination ice building and load chilling mode. The building cooling load is relatively low and the chiller system 60 can continue to provide twenty six degree fluid to the storage tank even if some of the circulating solution is pumped through and heated up by the building load. The pumps 20 will be maintained at full rated flow required for the ice building cycle, but valve 24 will be opened to circulate some of the chilled liquid through the load coils of the building. With the low building load, the return liquid in load outlet pipe 82 may only be about forty six degrees. When this returning liquid is blended with the larger amounts of twenty eight degree liquid leaving the storage tank, the liquid entering the inlet header 33 of the heat exchanger may only rise to about 29 degrees.

LIVE LOAD CHILLER MODE

However, as the building load increases during the morning, eventually the system will not handle the load with the chiller operating in the ice building mode. At about ten a.m., the system is switched over to the live load chilling mode for about an hour to save the stored ice for the peak demand period. (If the storage tank 10 were fully charged with ice before 10 a.m., the system might be switched to the live load chiller mode at that time. This could happen during weather periods when the peak demand is lower than normal.)

In the live load chiller mode, the control system sets the suction temperature to a higher value, e.g. around forty degrees F. and the values 23 and 26 are closed while valves 24 and 25 are open. Pumps 20 are set to the lower flow rate required for the load side of the system. The heat transfer liquid thus is circulated directly between the chiller system 60 and the utilization circuit 80.

LIVE LOAD CHILLER AND ICE THAWING MODE

When the system operating in the live load chilling mode is no longer able to keep up with the cooling demand, the system is switched to the combined live load chilling and ice thawing (discharging) mode of operation. In the example, this occurs at about 11 a.m., prior to the start of the peak demand period at noon, and thus it is economical to continue operating the refrigeration system. The control system maintains the same suction temperature for the live load chilling mode of the chiller system 60, and the pumps 20 are operated at the same lower flow rate, but the valve 26 is opened to begin pumping the solution through storage tank 10. The chiller system cools the return water from the building load before it reaches the storage tank and the ice in the ice encapsulating units within the storage tank provides the remainder of the cooling to bring the solution to the design temperature.

THE ICE THAWING MODE

At noon, the control system 55 shuts off the refrigeration system and the system begins operating in the ice thawing mode (or discharge mode). Pumping volume is kept at the low value required for the load side cooling coils in the utilization circuit 80. At 6 p.m. the utilization circuit is shut down, and the system is once more set to operate in the ice building (charging) mode during the evening and night hours.

THE STRUCTURE AND FUNCTION OF THE ICE ENCAPSULATING UNITS

FIGS. 6–8 and 9A illustrate configurations of ice encapsulating units that are preferred for use in the system of this invention. One configuration of ice encapsulating unit is the blowmolded polyethylene container 120 shown in FIGS. 6 and 7. Container 120 has the shape of a regular parallelepiped with major top and bottom walls 122 and 123 having length and width dimensions that are several times greater than the smaller dimensions of the side walls 124 and 125. Preferably this larger container 120 holds at least several gallons of liquid. The walls of the container are designed to have a thickness such that the walls are flexible and permit expansion of the internal volume of the container when the liquid inside freezes.

By using the container shape shown in FIGS. 6 and 7, the ice encapsulating units are readily adapted to be stacked one on top of the other as well as side to side and end to end to form a three dimensional array of containers. Container 120 has an arrangement of projections 129A formed on the bottom wall thereof and also an arrangement of projections 130 on the top wall thereof. When two containers are stacked, these projections space the respective top and bottom walls away from each other to form liquid flow channels therebetween as illustrated in FIG. 9A.

The containers 120A in FIG. 9A have an arrangement of projections 129A only on a bottom wall 122 thereof. This is considered the minimum type of configuration of projections to produce flow channels between container walls and space for expansion of the container walls during freezing. As shown by the dashed lines in FIG. 9A, during the freezing of the liquid inside the container, the top and bottom walls will bulge out into the flow channel between containers. This displaces some of the liquid in the flow channels and results in displacement of liquid into the topping tank as previously described.

As shown in FIGS. 6 and 7 the container 120 preferably has a cap arrangement 128 formed thereon. This cap arrangement comprises a threaded neck integrally formed on the container and a plastic screw on cap with a self adhesive liner (not shown) and a foam backing piece (not shown) mounts on the container neck to seal the container. It should be understood that this invention is not limited to use of any particular system for filling and sealing the ice encapsulating units. Other type of field installed sealing arrangements could be employed. In addition, this invention could also be implemented by filling and sealing the containers forming the ice encapsulating units at a factory site and shipping the filled units to the installation site. However, this approach substantially increases the shipping costs, so the preferred embodiment of this invention uses containers that are adapted to be shipped empty to the installation site and filled and sealed at that location. FIG. 8 illustrates a second configuration of a smaller container 121 that is useful to fill in gaps in the stack of containers that are too small for the larger container to fit.

As an example of container dimensions, the container 120 may have dimensions of sixteen by thirty by three inches and about a five gallon capacity. Container 121 may have dimensions of four by thirty by three inches and have about a 1.25 gallon capacity. These container configurations have been shown to work reasonably well in large storage tanks with a diameter between six and ten feet. The five gallon capacity of the larger containers produces a filled container weight of about forty pounds and is easily handled by an installation crew .

Based on experience with initial installations of the invention, it has been determined that it is preferrable to use a more narrow container to provide a greater ratio of surface area to volume. Containers with a side wall dimension in the range of one and one half to two inches and holding about two gallons of water are presently preferred. Generally it is preferred that the containers have at least about two square feet of surface area per gallon of contained liquid. It should, however, be understood that this invention is not limited to any particular size or configuration of container for the ice encapsulating units and the principles of the invention can be realized in a wide variety of designs and sizes.

It is also believed to be important to provide adequate separation between the overlying ice encapsulating units in order to have adequate flow of the working heat transfer liquid over the outer surfaces thereof. The presently preferred spacing is about three fourths of an inch, but this spacing dimension is not critical to the operation of the system. Larger spacing could also be used, but will reduce the volumetric ice storage efficiency as the spacing is increased. Generally, the spacing must provide flow channels between ice encapsulating units of adequate size during the entire freeze cycle with no substantial blockage of these channels as the container walls expand into the channel due to ice formation inside the ice encapsulating units.

As shown in FIG. 9A, a small volume of a freeze enhancement material 131 in the form of powdered cholesterol material, preferably a commercial refined grade of powdered cholesterol available from U.S. Biochemical Corporation is placed inside each container before it is filled with liquid. This may be done prior to shipping the container to the installation site or may be done at the site itself. A small squeeze bottle may be used to dispense a small volume of the powdered cholesterol into the container. The amount of cholesterol should be at least about 0.1 gram and may conveniently be in the range of 0.1 to 1 gram.

This freeze enhancement material seems to raise the temperature at which the liquid inside the container starts to freeze and has been shown in practice to be an important aspect of effective operation of the invention during the freeze cycle. As is well known, a contained body of liquid such as water may have to be subcooled to a temperature as low as eighteen degrees F. before the first ice crystals form therein. Once ice crystals begin to form, the liquid will then continue to freeze at the normal freezing temperature thereof. The presence of the freeze enhancement material in the container of water appears to raise the temperature at which initial ice crystals are formed.

It is not precisely known how or why this freeze enhancement material works. The powdered cholesterol crystals appear to provide a nucleating site for ice crystals. The initial nucleating activity is such that initial ice nucleation will occur near the freezing point of the deionized water. Some of the activity is lost after four or five cycles, but the cholesterol maintains a useful degree of ice nucleating ability throughout repeated cycling and promotes initiation of ice formation at about twenty five degrees F. This enhancement enables the refrigeration system to deliver cooling to the ice encapsulating units more efficiently during the initial freezing cycle after a complete melt of the ice in most of the units.

The containers to be used in a installation of the system of this invention are shipped empty to the installation site, along with the caps and freeze enhancement material. For convenience in filling the containers, a container filling fixture illustrated schematically in FIG. 10 may be provided to the installers. The fixture 140 holds a plurality of containers 120 in vertical orientation and constrains the top and bottom walls of each container so that it will be filled to its normal capacity, i.e. the normal container volume without deformation of the top and bottom walls. Since the walls of the container are flexible, it is possible to load as much as eight gallons or more of water into a five gallon container with the sides expanding until the container is shaped like a rounded pillow. It is important to maintain the initial shape of the containers during filling so that the ice encapsulating units will stack in a more regular stacking pattern in the storage tank.

After the empty containers are loaded into the fixture 140, a flow distribution header is placed over the containers with the individual pipes on the bottom thereof inserted into the open necks on the containers. The distribution header 141 is connected to the outlet of a deionizer tank 142 which in turn is connected to a source of tap water. A valve 143 controls the flow of deionized water into the distribution header. Using this loading fixture arrangement, one group of the installation crew can be filling the ice encapsulating units while another group is installing the filled ice encapsulating units in the storage tank.

FIGS. 9A and 9B illustrate one advantage of using the preferred form of container according to this invention as depicted in FIG. 9A, compared to use of a spherical container as depicted in FIG. 9B. As shown in FIG. 9A, as ice is formed on the inner walls of container 120 A, there remains a large heat transfer surface at the liquid/ice interface within the container. The amount of heat transfer surface area does not decrease drastically as the ice is formed. The efficiency of heat transfer to the unfrozen liquid is reduced by the layer of ice, but the ratio of heat transfer surface to unfrozed liquid volume remains high. In contrast, in a spherical container as illustrated in FIG. 9B, the heat transfer surface area decrease dramatically as layers of ice form on the inner wall surfaces of the container.

FIGS. 11 and 12 illustrate another advantage of using the configuration of container which is preferred for the system of this invention. In the prior art, as shown in FIG. 11, ice encapsulating units are formed as regular spheres which are typically only partially filled with water because the sphere cannot expand in volume. During thawing of the ice in the spherical container, the ball of ice will float to the top of the sphere and only a relatively small surface area of the ice will be in contact with the wall surface for direct conductive heat transfer. The remainder of the ice ball will be in contact with water and have a longer heat transfer path to the container wall. As the melting of the ball continues, the area of the ice ball in contact with the surface will enlarge because the contact area will melt faster than the surrounding area, but the percentage of the ice ball surface in direct contact with the wall of the sphere will remain small.

In contrast, the regular parallelepiped shape of the ice encapsulating units used in a preferred version of this invention keeps major portions of the top surface of the floating ice block in direct contact with or close proximity to the top wall of the container. This enhances the heat transfer from the container wall to the ice block and permits faster melting of the ice to produce the desired outlet chilled water temperature from the storage tank in which the frozen ice encapsulating units are contained.

The characteristics of the preferred form of ice encapsulating units in accordance with this invention also appear to provide improved freeze characteristics. During the ice building cycle, cracking noises are heard in the tank during the initial portion of the freezing cycle. It is believed that the initial ice layers formed on the inside walls of the container break into pieces and thus allow a liquid layer to contact the wall surface again. This enhances heat transfer and improves the rate of ice formation. The explanation for this phenomena is uncertain. It may be that it is caused by change in shape of the container walls as ice formation increases the internal volume.

The system and method of this invention have been described in both general concept and specific embodiment to illustrate the principles of the invention. It should be understood that persons of ordinary skill in the art could make numerous changes in the details of implementation of the general system and method of this invention without departing from the scope of the invention as claimed in the following claims.

What is claimed is:

1. In a chill water system, in combination:

structural means defining a vessel for containing a volume of a first liquid characterized by a first freezing temperature substantially lower than water;

a multiplicity of ice encapsulating units disposed in said vessel and occupying a major portion of the volume thereof, each of said ice encapsulating units comprising sealed container means being filled with water and having a volume of cholesterol therein serving as an ice nucleating agent for said water; and a liquid chilling system operatively associated with said vessel for cooling said first liquid in said vessel to a temperature above said first freezing temperature and below the freezing temperature of water.

2. Apparatus as claimed in claim 1, wherein said volume of cholesterol is commercial refined grade cholesterol in powdered form.

3. An ice encapsulating unit adapted for use in a chill water system comprising sealed container means, a volume of water carried in said sealed container means, and a volume of cholesterol carried on the interior of said sealed container means and serving as an ice nucleating agent to raise the initial ice nucleating temperature of said water therein.

4. Apparatus as claimed in claim 3, wherein said volume of cholesterol is commercial refined grade cholesterol in powdered form.

5. A method for producing chilled water comprising the steps of:

a. forming a container for a holding a volume of water;

b. disposing a small volume of cholesterol within the interior of said container to serve as an ice nucleating agent;

c. dispensing a volume of water into said container;

d. sealing said container;

e. circulating a chilled heat transfer fluid over said sealed container during a freeze cycle until said water on the inside of said container is entirely converted to ice; and f. circulating said heat tranfer fluid over said sealed container during a thaw cycle to entirely melt said ice inside said container;

g. performing steps e and f repeatedly with said volume of cholesterol repeatedly serving to raise the initial ice nucleation temperature of said water and thereby enhancing the ice formation within said container and increasing the energy efficiency of performing step f.

6. The method of claim 5, wherein said step b, is performed by spraying a small volume of commercial refined grade powdered cholesterol into said container.

* * * * *